United States Patent [19]

Wolfe

[11] 4,140,475

[45] Feb. 20, 1979

[54] COMBUSTION DETECTION APPARATUS

[75] Inventor: Denis G. Wolfe, Santa Ana, Calif.

[73] Assignee: Robertshaw Controls Company, Richmond, Va.

[21] Appl. No.: 701,292

[22] Filed: Jun. 30, 1976

[51] Int. Cl.[2] ..... F23Q 9/08; F23N 5/00

[52] U.S. Cl. ..... 431/42; 431/76

[58] Field of Search ..... 431/42, 80, 81, 76; 204/195 S; 137/65, 66, 457, 487.5; 251/129, 130; 136/233, 239

[56] References Cited

U.S. PATENT DOCUMENTS

| | | | |
|---|---|---|---|
| 2,080,070 | 5/1937 | Wright et al. | 431/42 X |
| 2,381,926 | 8/1945 | Ray | 137/457 X |
| 2,766,440 | 10/1956 | Marsden, Jr. | 136/233 X |
| 3,213,922 | 10/1965 | Weber | 431/42 |
| 3,213,922 | 10/1965 | Weber | 431/42 |
| 3,462,318 | 8/1969 | Bjornson | 136/233 |
| 3,645,875 | 2/1972 | Record et al. | 204/195 S |
| 3,914,169 | 10/1975 | Horowitz | 204/195 S |
| 4,032,286 | 6/1977 | Kobayashi et al. | 431/76 |
| 4,037,773 | 7/1977 | Record | 228/122 |

OTHER PUBLICATIONS

"Solid Electrodes - New Applications for $ZrO_2$", Zircoa News Focus Chemetals Division, Diamond Shamrock Chemical Co.-10/20/75.

*Primary Examiner*—Edward G. Favors
*Assistant Examiner*—Larry Jones
*Attorney, Agent, or Firm*—Fulwider, Patton, Rieber, Lee & Utecht

[57] ABSTRACT

An improved combustion detection apparatus is disclosed that can be employed in a fail-safe control circuit for a combustion apparatus to operate a shut-off valve in the fuel supply in response to the presence or absence of combustion. The improved combustion detector is an electrode assembly of a solid metal oxide member and electrodes in the form of electrical conducting coatings on opposite sides of the metal oxide member. The metal oxide has the characteristic of generating an electromotive force by transfer of oxygen ions therethrough. The combustion detector is placed in the vicinity of a flame from a pilot or main burner of the combustion apparatus. The oxygen gradient established by the burner flame and the resultant high temperature of the metal oxide member provides an instantaneous response to ignition or extinguishment of the burner flame. There is also disclosed an improved metal coating and method for its application on the metal oxide member which greatly increases its operational life over metal coatings of the prior art.

14 Claims, 6 Drawing Figures

FIG. 1
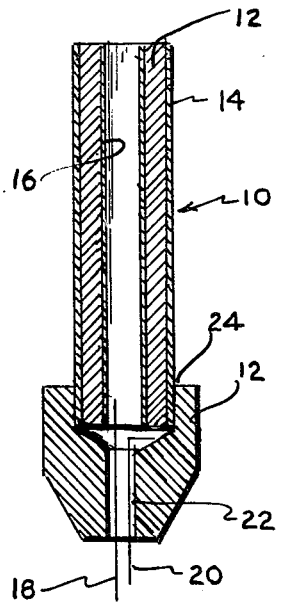
FIG. 3
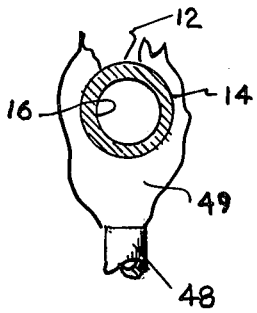
FIG. 4
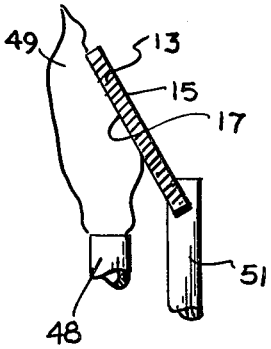
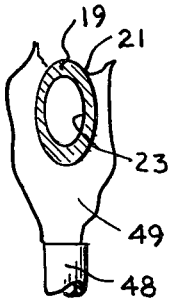
FIG. 5
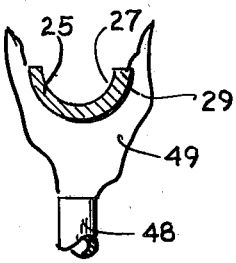
FIG. 6
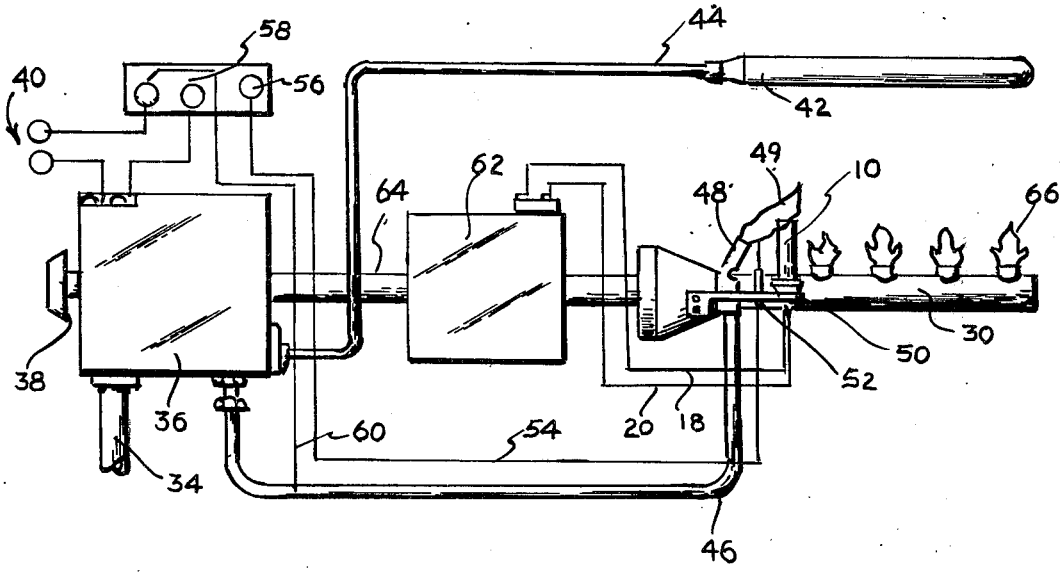
FIG. 2

COMBUSTION DETECTION APPARATUS

BACKGROUND OF THE INVENTION

1. Brief Statement of the Invention

This invention relates to a combustion detector and, in particular, to combustion apparatus provided with a safety shutoff system in its fuel supply.

2. Brief Statement of the Prior Art

Combustion apparatus such as gas and oil burners and the like have been provided with safety controls that include a shutoff valve in the fuel supply lines with a combustion detection facility such as a thermocouple positioned adjacent the pilot burner of the apparatus whereby the shutoff valve is maintained open only when a flame is present at the pilot burner. Another type of safety control employed in industrial combustion apparatus includes an optical scanner which is responsive to the light emitted by a flame to produce an electrical output that controls the position of the safety shutoff valve.

The employment of thermocouples as the combustion detector as in most household appliances such as furnaces, water heaters and the like, has some disadvantage in that the thermocouple does not have a rapid response to extinguishment of a burner flame and, therefore, must be employed in combustion equipment provided with a continuously burning pilot burner. Optical scanners such as employed in industrial burners are difficult to adjust and use.

It has also been know that certain metal oxides such as zirconia have the ability to generate an electromotive force by transfer of oxygen therethrough and electrode assemblies employing such metal oxides have been used for measurement of oxygen gradients and for fuel cells. Typical of an electrode assembly is that disclosed in U.S. Pat. No. 3,645,875.

Brief Statement of the Invention

We have now found that an electrode assembly of a metal oxide and electrical conductive coatings can be employed as a very sensitive and responsive combustion detector, providing substantially instantaneous response to the extinguishment of a flame when positioned in direct contact with the flame. The oxygen gradient established by the flame and the high temperature to which the electrode assembly is heated cooperate to provide this very rapid response and also generate a relatively high electromotive force, e.g., up to about 0.5–1.0 volt, which is suitable for the direct actuation of control valves.

The invention includes a combustion apparatus with a fuel source having a fuel supply conduit with a control valve movable between open and closed positions, combustion means connected the fuel supply means, such as a solenoid and the like operative to move the control valve between its open and closed positions and combustion detection means including the aforedescribed electrode assembly with conductor means extending from the electrodes of the electrode assembly to the valve control means. The electrode assembly is supported adjacent the combustion means with the metal oxide member exposed to a gradient of oxygen concentration and elevated temperature produced by combustion at the combustion means.

The invention also comprises a method for coating of the metal oxide member with a Group VIII noble metal and heating the coating at a temperature greater than about 1900° F. but below the melting point of the metal and in a hydrogen atmosphere whereby a coating of improved life and operating characteristics is achieved, and the product produced thereby.

BRIEF DESCRIPTION OF THE DRAWINGS

The invention will be described by reference to the FIGURES of which:

FIG. 1 illustrates an electrode assembly useful in the invention;

FIG. 2 illustrates a combustion apparatus employing the electrode assembly of the invention; and FIGS. 3–6 illustrate various cross-sectional shapes for the electrode assembly.

DESCRIPTION OF PREFERRED EMBODIMENTS

Referring now to FIG. 1, an electrode assembly 10 is shown carried in support 12. The assembly is a generally tubular construction with a cylindrical metal oxide member 12 that has its outer and inner surfaces coated with electrically conducting layers 14 and 16, respectively. The layers 14 and 16 comprise electrodes which are in electrical contact with conductors such as wires 18 and 20 that are secured to the coatings by any suitable means such as soldering, fusion and the like.

The electrode assembly is carried in a support 11 which has a central bore 22 for receiving the conductors 18 and 20 and a larger diameter counterbore 24 for receiving one end of the electrode assembly.

The electrode assembly can be constructed with various materials. The metal oxide selected for the cylinder 11 can be any solid metal oxide having the property of transferring oxygen ions when exposed to an oxygen differential across its surfaces and in generating an electromotive force in response thereto. Various solid metal oxides can be employed for this purpose including the Group IVB metal oxides such as titania, zirconia and hafnia, alone or mixtures thereof, in combination with various stabilizing materials such as oxides of Group IIA and/or Group IIIB metals such as beryllia, magnesia, calcia, zirconia, yttria, lanthia, etc. The amount of the stabilizer metal oxide that can be used can be from 0 to about 12 weight percent, preferably from about 2 to about 10 weight percent. The preferred metal oxide is zirconia, i.e., zirconium dioxide, and the preferred stabilizers are yttria, $Y_2O_3$, or calcia, CaO.

Various materials which are electrical conductors can be used for the coating of the metal oxide cylinder. The coatings should, of course, be stable at high temperatures and should, therefore, have high melting points in excess of normal flame temperatures, e.g., in excess of about 2000° F. The coating should also be oxygen permeable to insure that minimal resistance will be presented to oxygen transfer through the metal oxide member. Suitable coatings include non-metallic coatings such as compositions of molybdenum silicide, $MoSi_2$; silicon carbide, SiC; carbon, e.g., graphite, as well as metal coatings, e.g., coatings of Group VIII noble metals such as palladium, platinum, rhodium, iridium, etc. or Group IB metals such as silver, gold, etc.

The electrode coatings are applied to the metal oxide member preferably in the form of a suspension in a ceramic paint such as an emulsion of polyvinyl alcohol and the like. The coating particles of metal, silicides, or carbides are dispersed in the emulsion as finely subdivided particles, e.g., particles having a size range passing a 325 mesh screen are acceptable. The emulsion with the suspended solid electrode particles is coated on the surfaces of the metal oxide member by brushing, dipping, spraying and the like, to apply a film having a thickness from 0.5 to about 3 mills thickness. Thereafter the coating is dried and is subjected to elevated temperatures for removal of the emulsion. In the preferred embodiment, particularly with the Group VIII noble metals, the coated member is heated to a temperature at least above 1900° F., preferably at least above 2000° F. but below the melting point of the metal and in a hydrogen atmosphere. It has been found that this treatment of the metal coated metal oxide member results in a metallic electrode coating which has a superior operational life when the electrode assembly is subjected to flame temperatures as a combustion detector.

If desired, the metal coating prepared by conventional firing in a vacuum at temperatures of 2400° F. or greater or the metal coating prepared in accordance with the aforedescribed technique, can be further coated with a protective layer of metal oxide in admixture with particles of the metal employed for the electrode coating. Thus, finely subdivided powders of the metal oxide can be admixed in proportions of from 1:2 to 2:1 with the finely subdivided metal employed for the electrode metallic surface, the resultant mixture can be suspended in the ceramic emulsion binder and coated over the metal electrode surfaces. It has been found that this provides a protective overlayer which extends the operational life of the electrode assembly.

Referring now to FIG. 2, there is illustrated a typical application of the invention. A burner 30 is provided with fuel supply means including a source of fuel such as a conduit 34 communicating with a pressured supply of a combustible gas such as natural gas, ethane, propane, and the like. The conduit 34 communicates with a control valve 36 which includes control means such as dial 38 for setting the operational temperature of the appliance. Typically the burner assembly shown in FIG. 2 can be employed for oven heating and dial 38 is a switch for setting the temperature of the oven. The valve mechanism 36 includes an electrically operated control valve which is supplied with a source of electrical energy such as a 24 volt alternating current through terminals 40. The valve mechanism also includes an oven temperature sensing device such as sensing bulb 42 having a conduit 44 extending to a pressure actuated valve that supplies gas to conduit 46. Conduit 46 extends to the pilot combustion means which is pilot burner 48. The pilot burner 48 is supported by bracket 50 which is attached to the burner casting 30 and which also supports electrode 52. Electrode 52 is coupled through conductor 54 to terminal 56 of the ignitor circuit 58. The ignitor circuit is grounded through conductor 60 and an electrical potential is applied to the electrode 52 simultaneous with the opening of the gas supply valve and discharge of gas into conduit 46, resulting in generation of a spark at the electrode and ignition of the gas discharging from pilot burner 48.

The electrode assembly 10 of the invention is mounted on bracket 50 at a position adjacent the flame 49 produced by burner 48 such that the electrode assembly is heated to an elevated temperature by the pilot flame 49 and is exposed to the oxygen gradient resulting from the deficiency of oxygen by the flame.

The exposure of the electrode assembly 10 to the flame 49 of pilot burner 48 results in substantially instantaneous generation of an electromotive force between the electrode surfaces 14 and 16 of the assembly (shown in FIG. 1). This electromotive force is applied through conductors 18 and 20 to the terminals of valve 62 which can be a direct acting millivolt electromagnetic valve that is positioned in conduit 64. The latter conduit provides the main gas supply to the burner 30. Valve 62 is a normally closed valve which is opened by the application of the electromotive force developed by the electrode assembly 10 which can be of the order of from 0.1 to about 1.0 volt. Supply of the combustible gas to the burner 30 will result in ignition and formation of the burner flames 66 along the length of the burner 30 in a conventional fashion.

When the oven reaches the temperature set by the dial 38, the valve mechanism 36 is operative to close the supply of gas from conduit 34, interrupting the supply of gas through conduits 46 and 64 and extinguishing the burner flames 66 and 49. The electromotive force developed by the electrode assembly 10 ceases almost instantaneously, permitting valve 62 to close and reestablishing the mechanism for ignition upon demand from the temperature sensing unit 42.

The electrode assembly has been described with reference to a hollow cylindrical member 12. This member is shown in cross section in FIG. 3 exposed to the burner flame 49 from the pilot burner 48. It is, of course, apparent that other shapes or dimensions of the electrode assembly can be employed. FIG. 4 illustrates the electrode assembly as a generally flat, planar, solid metal oxide member 13 having metal oxide coatings 15 and 17 and supported by a suitable bracket member 51 which engages an edge of the plate assembly. FIG. 5 illustrates an alternative embodiment in which the metal oxide member 19 is provided with an elliptical cross section and with electrically conducting surfaces 21 and 23. FIG. 6 illustrates another embodiment of the invention in which the metal oxide member 25 is provided in the form of a generally U-shape or a semicircle and the like with conducting layers 27 and 29. This member is supported in the flame 49 in the illustrated manner. In all of the illustrated embodiments, there will be established an oxygen gradient across the thickness of the metal oxide member with a decreasing oxygen concentration in the direction of the flame 49. In all of these embodiments, the metal oxide member is, furthermore, in contact with the flame so that its temperature approaches flame temperatures. This combination of high oxygen gradients and high temperatures insures development of the maximum electromotive force from the metal oxide member since the electrical resistance of the metal oxide member varies inversely with its temperature. The result of the two effects is to produce an almost instantaneous, maximum electromotive force by contact of the electrode assembly with a burner flame.

The following example will serve to illustrate the coating method of the invention and demonstrate results obtainable thereby.

EXAMPLE

Hollow cylindrical members formed of a matrix of about 92 weight percent zirconia and 8 weight percent yttria were used in the example. Each of the cylindrical members is approximately one inch long with an outside diameter of 0.25 inch and and inside diameter of 0.187 inch. In the experiments, each cylinder is coated with a polyvinyl alcohol emulsion containing 20 to 70 weight percent of flakes. of metallic platinum, which is applied by brushing. The coatings are permitted to dry and one of the cylinders so coated is placed in an oven which is evacuated and heated to a temperature of about 2400° F. In the second experiment the oven is purged and filled with hydrogen and the coated cylinder is heated therein to a temperature of 2100° F.

Electrical wire conductors are soldered to the inner and outer cylindrical electrode coatings on each of the electrode assemblies, the assemblies are placed in a holder such as that illustrated in FIG. 1, and are exposed to the flame of a bunsen burner supplied with natural gas. The electrode assemblies are permitted to remain in the flame which is extinguished one to two times and immediately reignited each day. The initial response from each of the electrode assemblies is substantially equal and approximately 0.75 volt with an open circuit and about 0.5 volt when applied to a commercial millivolt electromagnetic valve such as used for valve 62 shown in FIG. 2. The electrode assembly having the metallic platinum coatings applied at 2400° F. in a vacuum fails in approximately three days whereas the electrode assembly having the platinum coating prepared by heating in the hydrogen atmosphere retains its original electromotive force after continuous exposure for three weeks.

The invention has been described with reference to the presently preferred and illustrated embodiment and by exemplification of the presently preferred method. It is not intended that the invention be unduly limited by this illustration of the presently preferred embodiments. Instead, it is intended that the invention be defined by the means and steps, and their obvious equivalents, of the following claims.

What is claimed is:

1. A combustion apparatus which comprises:

1. a fuel source including a fuel supply conduit having a controlled valve with a closure member moveable between valve open and valve closed positions;
2. combustion means to produce a combustion flame with fuel supply means connected thereto;
3. controlled valve control means operative to move said closure member between said positions;
4. combustion detection means comprising:
   i. an electrode assembly of a solid metal oxide member and electrodes comprising electrical conducting coatings on opposite sides of said oxide member, said metal oxide having the characteristic of generating an electromotive force when heated and when exposed to an oxygen gradient between said opposite sides by transfer of oxygen therethrough;
   ii. support means positioning one of said sides of said electrode assembly adjacent said combustion means to be in direct contact with the flame thereof and the opposite side in free-air circulation contact with said metal oxide member thereby exposed to a gradient of oxygen concentration and an elevated temperature produced by combustion at said combustion means; and
5. conductor means extending from said electrodes to apply said electromotive force directly to said controlled valve control means.

2. The combustion apparatus of claim 1 wherein said combustion means is a pilot burner of a burner assembly and apparatus also includes a main burner connected to said conduit downstream of said valve.

3. The combustion apparatus of claim 2 wherein said conduit includes main valve means between said source and said controlled valve means and wherein said fuel supply to said pilot burner is a branch conduit extending from downstream of said main valve to said combustion means.

4. The combustion apparatus of claim 3 including thermostat means operatively connected to said main valve to open and close said main valve in response to heating demand sensed by said thermostat means.

5. The combustion apparatus of claim 4 including ignition means adjacent said pilot burner and switch means to actuate said ignition means in response to said thermostat means.

6. The combustion apparatus of claim 5 wherein said metal oxide is zirconia.

7. The combustion apparatus of claim 6 wherein said conducting coatings are metallic.

8. The combustion apparatus of claim 6 wherein said conducting coatings are platinum.

9. The combustion apparatus of claim 8 wherein said electrode assembly has said platinum coating sintered in hydrogen at a temperature above 1900° F. but below its melting point.

10. The combustion apparatus of claim 6 wherein said conducting coatings are non-metallic.

11. The combustion apparatus of claim 1 wherein said solid oxide member is an open-ended cylinder with said coatings on the inner and outer walls thereof.

12. The combustion apparatus of claim 11 wherein said open-ended cylinder is positioned for direct flame contact with said outer wall.

13. The combustion apparatus of claim 11 wherein said solid oxide is zirconia which contains from 2 to about 10 weight percent of yttria or calcia.

14. The combustion apparatus of claim 13 wherein said conducting coatings are platinum.

* * * * *